US010408196B2

(12) United States Patent
Huang

(10) Patent No.: US 10,408,196 B2
(45) Date of Patent: Sep. 10, 2019

(54) PISTON SHIFTING CONTROL SYSTEM

(71) Applicant: Federal Signal Corporation, Oak Brook, IL (US)

(72) Inventor: Xiaolun Huang, Naperville, IL (US)

(73) Assignee: Federal Signal Corporation, Oak Brook, IL (US)

( * ) Notice: Subject to any disclaimer, the term of this patent is extended or adjusted under 35 U.S.C. 154(b) by 568 days.

(21) Appl. No.: 15/043,723

(22) Filed: Feb. 15, 2016

(65) Prior Publication Data

US 2016/0245266 A1 Aug. 25, 2016

Related U.S. Application Data

(60) Provisional application No. 62/119,322, filed on Feb. 23, 2015.

(51) Int. Cl.

| | |
|---|---|
| ***F04B 1/06*** | (2006.01) |
| ***F04B 9/113*** | (2006.01) |
| ***F04B 49/06*** | (2006.01) |
| ***F04B 49/12*** | (2006.01) |

(52) U.S. Cl.

CPC ..... *F04B 1/06* (2013.01); *F04B 9/113* (2013.01); *F04B 49/06* (2013.01); *F04B 49/12* (2013.01); *F04B 2201/0201* (2013.01)

(58) Field of Classification Search

CPC .. F04B 1/06; F04B 9/113; F04B 9/133; F04B 49/06; F04B 49/065; F04B 49/12; F04B 2201/0201; F04B 2201/0206

See application file for complete search history.

(56) References Cited

U.S. PATENT DOCUMENTS

| | | | | |
|---|---|---|---|---|
| 3,666,141 | A * | 5/1972 | Ma | B29C 45/461 222/1 |
| 3,700,360 | A * | 10/1972 | Shaddock | F01L 25/063 417/390 |
| 4,255,088 | A * | 3/1981 | Newton | A61M 5/365 417/1 |
| 4,566,868 | A * | 1/1986 | Menzies | F04B 35/04 417/18 |
| 4,965,713 | A * | 10/1990 | Hong | G05B 13/0265 417/18 |
| 4,990,058 | A * | 2/1991 | Eslinger | F04B 9/113 417/18 |
| 5,092,744 | A * | 3/1992 | Boers | F04B 9/105 137/533.21 |
| 6,203,288 | B1 * | 3/2001 | Kottke | F04B 11/00 417/328 |
| 6,329,013 | B1 * | 12/2001 | Putt | B05C 11/1034 222/1 |

* cited by examiner

*Primary Examiner* — Patrick Hamo
*Assistant Examiner* — Joseph S. Herrmann
(74) *Attorney, Agent, or Firm* — Merchant & Gould P.C.

(57) ABSTRACT

A piston shifting control system is provided to control a displacement pump to maximize a stroke length of a piston and prevent damages to the entire pump system. The displacement pump may include a linear variable displacement transducer (LVDT) inserted through one end of a cylinder body and used to detect a position of the piston within the cylinder. The shifting control system is configured to monitor a position of the piston assembly in the displacement pump and adjust a shifting trigger point of the piston assembly in each stroke to maximize the stroke length.

14 Claims, 12 Drawing Sheets

PISTON SHIFTING CONTROL SYSTEM

CROSS-REFERENCE TO RELATED APPLICATION(S)

This application claims the benefit of U.S. Patent Application Ser. No. 62/119,322, titled PISTON SHIFTING CONTROL SYSTEM, filed Feb. 23, 2015, the disclosure of which is hereby incorporated by reference in its entirety.

BACKGROUND

Reciprocating pumps operate to move fluid using one or more oscillating pistons, plungers, or membranes while valves selectively restrict the fluid to move to a desired direction. Reciprocating pumps are used in many applications, such as mobile utility vehicles. Examples of such mobile utility vehicles include sewer cleaners and hydro-excavators, which can be collectively referred to as debris collection vehicles. In certain examples, debris collection vehicles typically have one or more reciprocating displacement pump as a water pump.

Reciprocating displacement pumps can be controlled by a shifting mechanism. The shifting mechanism operates to control alternating movements of one or more piston (double acting) or plunger (single acting) reciprocating in a pump. In certain examples, the shifting mechanism includes one or more mechanical elements, such as mechanical linkages and proximity switches, to find the location of a moving piston or plunger near the dead center thereof within an associated cylinder and change the direction of the piston or plunger in each stroke. An example of the shifting mechanism is disclosed in U.S. Pat. No. 3,700,360, the entirety of which is incorporated herein by reference.

In general, it is desirable to increase a stroke length of a piston within a cylinder to prolong a product life and increase fuel efficiency. To maximize the stroke length of a piston, a shifting position of the piston within the cylinder needs to be arranged as close as possible to an end of the cylinder to reduce the number of strokes at a given flow rate. Setting the shifting position of the piston away from the end of the cylinder shortens the stroke length of the piston and therefore increases the number of piston strokes to fulfill the same flow rate. On the other hand, setting the shifting position of the piston too close to the end of the cylinder can cause the piston to hit the end of the cylinder as the piston changes the direction of stroke. The piston hitting the end of the cylinder as it shifts its direction can damage several mechanical parts, such as piston and cylinder components. Further, such collision of the piston against the cylinder end leads to a pressure spike on hydraulic system and causes cooling components to fail.

SUMMARY

In general terms, this disclosure is directed to a piston shifting control system, which is also referred to herein as a piston shifting control system. In one possible configuration and by non-limiting example, the piston shifting control system operates to control a shifting trigger position of a piston at which a shifting of the piston begins within a cylinder. The shifting trigger position is controlled to maximize the stroke length of the piston while the piston does not hit a portion of the cylinder. In certain examples, the piston and cylinder assembly may include a piston position sensor assembly that is inserted through one end of a cylinder body and used to detect a position of the piston within the cylinder. The piston position sensor assembly may include a linear variable displacement transducer. Various aspects are described in this disclosure, which include, but are not limited to, the following aspects.

One aspect is a method of controlling a shifting position of a piston assembly reciprocating within a cylinder along a longitudinal axis. The method may include: selecting a target shifting position of the piston assembly adjacent a cylinder end head; detecting a shifting position of the piston assembly in a first cycle at which the piston assembly changes a direction of movement thereof in an opposite direction along the longitudinal axis; determining a difference between the target shifting position and the shifting position in the first cycle; and adjusting a shifting trigger position of the piston assembly in a second cycle to compensate for the difference, the second cycle being subsequent to the first cycle.

Another aspect is a method of controlling a shifting position of a piston assembly reciprocating within a cylinder along a longitudinal axis. The method may include: detecting a first speed of the piston assembly in a first cycle adjacent a cylinder end head; detecting a second speed of the piston assembly in a second cycle adjacent the cylinder end head, wherein the second cycle is subsequent to the first cycle; determining a difference between the first speed with the second speed; and adjusting a shifting trigger position of the piston assembly in the second cycle to make a shifting position in the second cycle substantially the same as a shifting position in the first cycle.

Yet another aspect is a displacement pump including a body, a piston assembly, and a piston position sensor assembly. The body defines a cylinder and includes a first cylinder end head and a second cylinder end head opposite to the first cylinder end head along a longitudinal axis of the cylinder. The piston assembly reciprocates within the cylinder and includes a piston head and a piston rod. The piston rod is connected to the piston head. The piston rod defines a rod hole axially extending therealong and is open toward the first cylinder end head of the body. The piston position sensor assembly includes a coil assembly and a probe assembly. The coil assembly defines a probe through-hole and is secured to the piston assembly such that the probe through-hole is axially aligned with the rod hole of the piston rod. The probe assembly is configured to cooperate with the coil assembly to detect a position of the piston within the cylinder. The probe assembly has a probe head and a probe rod. The probe head is secured to the first cylinder end head of the body. The probe rod axially extends from the probe head and is at least partially inserted into the rod hole of the piston rod through the probe through-hole of the coil assembly.

Yet another aspect is a water pump system including a displacement pump, a hydraulic fluid source, a water source, and a shifting control system. The displacement pump may include a first cylinder, a second cylinder, a piston assembly, and a piston position sensor assembly. The second cylinder is arranged coaxially with the first cylinder. The piston assembly includes a first piston head, a second piston head, and a piston rod. The first piston head is reciprocatingly movable within the first cylinder, and the second piston head is reciprocatingly movable within the second cylinder. The piston rod axially extends between the first and second piston heads. The piston position sensor assembly is attached to the piston assembly and configured to detect a position of the piston assembly. The hydraulic fluid source is configured to selectively provide hydraulic fluid to the first cylinder. The water source is configured to selectively provide water to the second cylinder. The shifting control system may include a directional control valve unit and a control device. The directional control valve unit is configured to control a movement of the piston assembly by selectively providing hydraulic fluid from the hydraulic fluid source to the first cylinder. The control device is configured to receive a piston position signal from the piston position sensor assembly and perform such a method as described above.

The above features and advantages and other features and advantages of the present teachings are readily apparent from the following detailed description of the best modes for carrying out the present teachings when taken in connection with the accompanying drawings.

DETAILED DESCRIPTION

Figure 1:
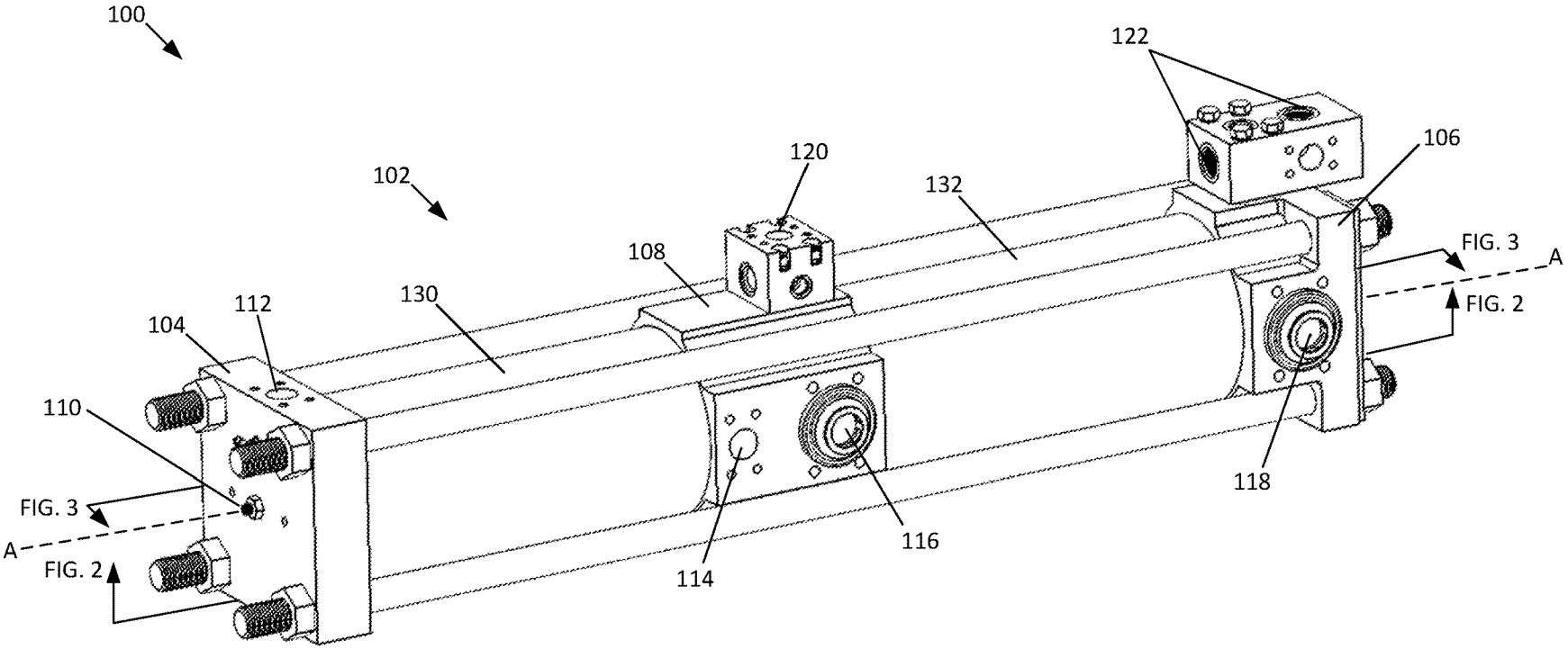
FIG. 1 is a perspective view of an example displacement pump.

Various embodiments will be described in detail with reference to the drawings, wherein like reference numerals represent like parts and assemblies throughout the several views.

In general, a piston shifting control system is provided to control a displacement pump to maximize a stroke length of a piston and prevent damages to the entire pump system. The displacement pump in accordance with the present disclosure may include a linear variable displacement transducer (LVDT) that is inserted through one end of a cylinder body and used to detect a position of the piston within the cylinder. The shifting control system is configured to monitor a position of the piston assembly in the displacement pump and adjust a shifting trigger position of the piston assembly in each stroke to maximize the stroke length. In certain examples, the shifting control system detects an actual shifting position of the piston near the end of the cylinder through the linearly variable displacement transducer and adjusts a shifting trigger position based upon a displacement error between a shifting target position (i.e., a target dead center) and the detected actual shifting position.

Figure 2:
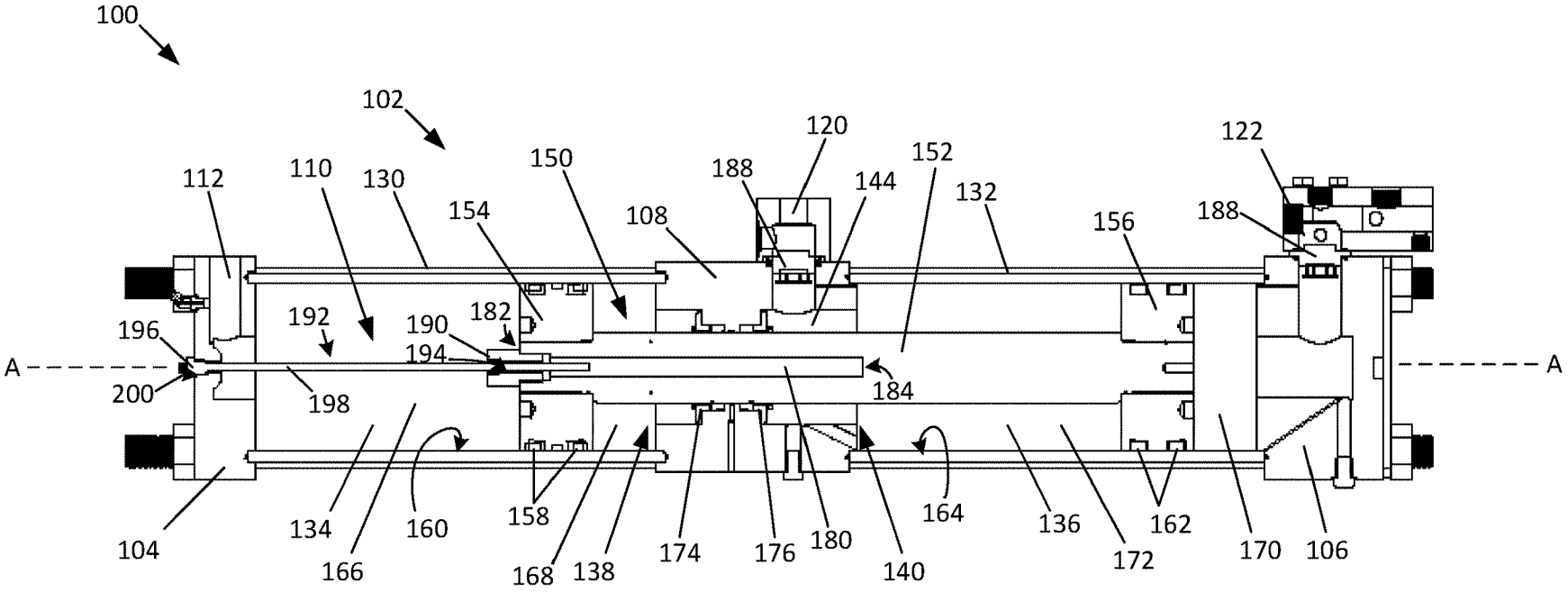
FIG. 2 is a cross-sectional view of the displacement pump of FIG. 1.
Figure 3:
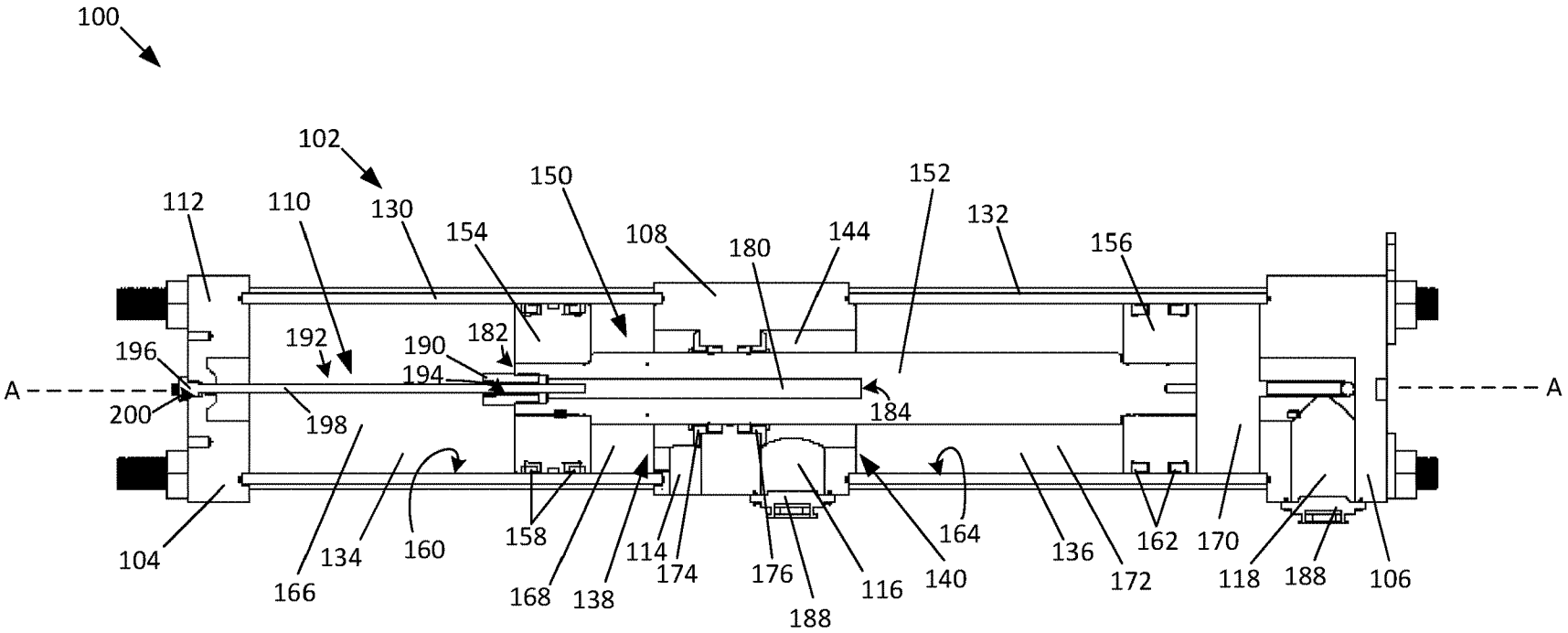
FIG. 3 is another cross-sectional view of the displacement pump of FIG. 1.

Referring to FIGS. 1-3, an example displacement pump 100 is illustrated and described employing the principles of the present disclosure. In particular, FIG. 1 is a perspective view of an example displacement pump 100, FIG. 2 is a cross-sectional view of the displacement pump 100 of FIG. 1, and FIG. 3 is another cross-sectional view of the displacement pump 100 of FIG. 1.

In the illustrated example, the displacement pump 100 is a double-acting tandem piston pump. In this document, the displacement pump 100 is illustrated and described primarily as the tandem piston pump. In other examples, however, the displacement pump 100 can be of different types and/or arrangements suitable for implementing the principles of the present disclosure.

The displacement pump 100 can include a cylinder body assembly 102, a first cylinder end head 104, a second cylinder end head 106, and an intermediate cylinder head 108.

The cylinder body assembly 102 defines one or more cylinders. In this example, the cylinder body assembly 102 includes two cylinders, such as a first cylinder body 130 and a second cylinder body 132. The first cylinder body 130 defines a first cylinder 134 therein, and the second cylinder body 132 defines a second cylinder 136. The first and second cylinder body 130 and 132 are coaxially arranged back-to-back along a longitudinal axis A with the intermediate cylinder head 108 interposed therebetween. The first and second cylinders 134 and 136 can be of the same or different sizes (e.g., diameters).

The first cylinder end head 104 is attached to the first cylinder body 130 on an opposite side to the intermediate cylinder head 108 (e.g., a first base portion 138 (FIG. 2)). The second cylinder end head 106 is attached to the second cylinder body 132 on an opposite side to the intermediate cylinder head 108 (e.g., a second base portion 140 (FIG. 2)). The first and second cylinder end heads 104 and 106 forms the opposite ends of the displacement pump 100 along the longitudinal axis A. The first cylinder end head 104 and the intermediate cylinder head 108 secured in opposite axial ends of the first cylinder body 130 define the first cylinder 134. Similarly, the second cylinder end head 106 and the intermediate cylinder head 108 secured in opposite axial ends of the second cylinder body 132 define the second cylinder 136.

The intermediate cylinder head 108 provides a first base portion 138 of the first cylinder 134 on one side thereof, and a second base portion 140 of the second cylinder 136 on the other side thereof. The intermediate cylinder head 108 defines a piston through-hole 144 extending therethrough along the longitudinal axis A. The piston through-hole 144 is configured to movably receive a piston rod 152 that extends therethrough into both of the first and second cylinders 134 and 136.

With continued reference to FIGS. 1-3, the displacement pump 100 includes a piston assembly 150 that can reciprocate in the first and second cylinders 134 and 136. The piston assembly 150 can include a piston rod 152 extending through the piston through-hole 144 of the intermediate cylinder head 108 into the first and second cylinders 134 and 136. Sealing elements 174 and 176 are provided at an inner surface of the intermediate cylinder head 108 to sealingly engage the piston rod 152 to prevent leakage between the first cylinder 134 (e.g., hydraulic fluid side) and the second cylinder 136 (e.g., water side).

The piston assembly 150 further includes a first piston head 154 and a second piston head 156. The first piston head 154 is secured to an end of the piston rod 152 in the first cylinder 134, and the second piston head 156 is secured to the opposite end of the piston rod 152 in the second cylinder 136. The first piston head 154 defines a first chamber 166 on one face thereof and a second chamber 168 on the opposite face thereof within the first cylinder 134. Similarly, the second piston head 156 defines a first chamber 170 on one face thereof and a second chamber 172 on the opposite face thereof within the second cylinder 136. One or more piston rings 158 are carried in grooves defined in the first piston head 154 and sealingly engage a cylinder wall 160 of the first cylinder 134. Similarly, one or more piston rings 162 are carried in grooves defined in the second piston head 156 and sealingly engage a cylinder wall 164 of the second cylinder 136.

The piston assembly 150 has an elongated rod hole 180 in the piston rod 152. In some embodiments, the rod hole 180 is defined coaxially with the piston rod 152 and extends along the longitudinal axis A. The rod hole 180 has an open end 182 and a closed end 184 along the longitudinal axis A within the piston rod 152. In the illustrated example, the open end 182 of the rod hole 180 is arranged toward the first cylinder end head 104 to be open to the first chamber 166 of the first cylinder 134. As described below, the rod hole 180 receives a probe assembly 192 of a sensor assembly 110 as the piston assembly 150 reciprocates within the first and second cylinders 134 and 136. The rod hole 180 has a longitudinal length suitable for at least partially receiving the probe rod 198 as the piston assembly 150 moves along the longitudinal axis A. For example, the longitudinal length of the rod hole 180 is not less than a maximum possible stroke length of the piston assembly 150 within the cylinder body assembly 102. A stroke is defined herein as a full travel of a piston along a cylinder in either direction between opposite dead centers (e.g., a top dead center and a bottom dead center).

With continued reference to FIGS. 1-3, the displacement pump 100 further includes a first hydraulic port 112, a second hydraulic port 114, a first water inlet port 116, a second water inlet port 118, a first water outlet port 120, and a second water outlet port 122.

In the illustrated example, the first hydraulic port 112 is defined in the first cylinder end head 104 and in fluid communication with the first chamber 166 of the first cylinder 134. The second hydraulic port 114 is defined in the intermediate cylinder head 108 and in fluid communication with the second chamber 168 of the first cylinder 134. The first water inlet port 116 is defined in the intermediate cylinder head 108 and in fluid communication with the second chamber 172 of the second cylinder 136. The second water inlet port 118 is defined in the second cylinder end head 106 and in fluid communication with the first chamber 170 of the second cylinder 136. The first water outlet port 120 is defined in the intermediate cylinder head 108 and in fluid communication with the second chamber 172 of the second cylinder 136. The second water outlet port 122 is defined in the second cylinder end head 106 and in fluid communication with the first chamber 170 of the second cylinder 136.

Figure 5:
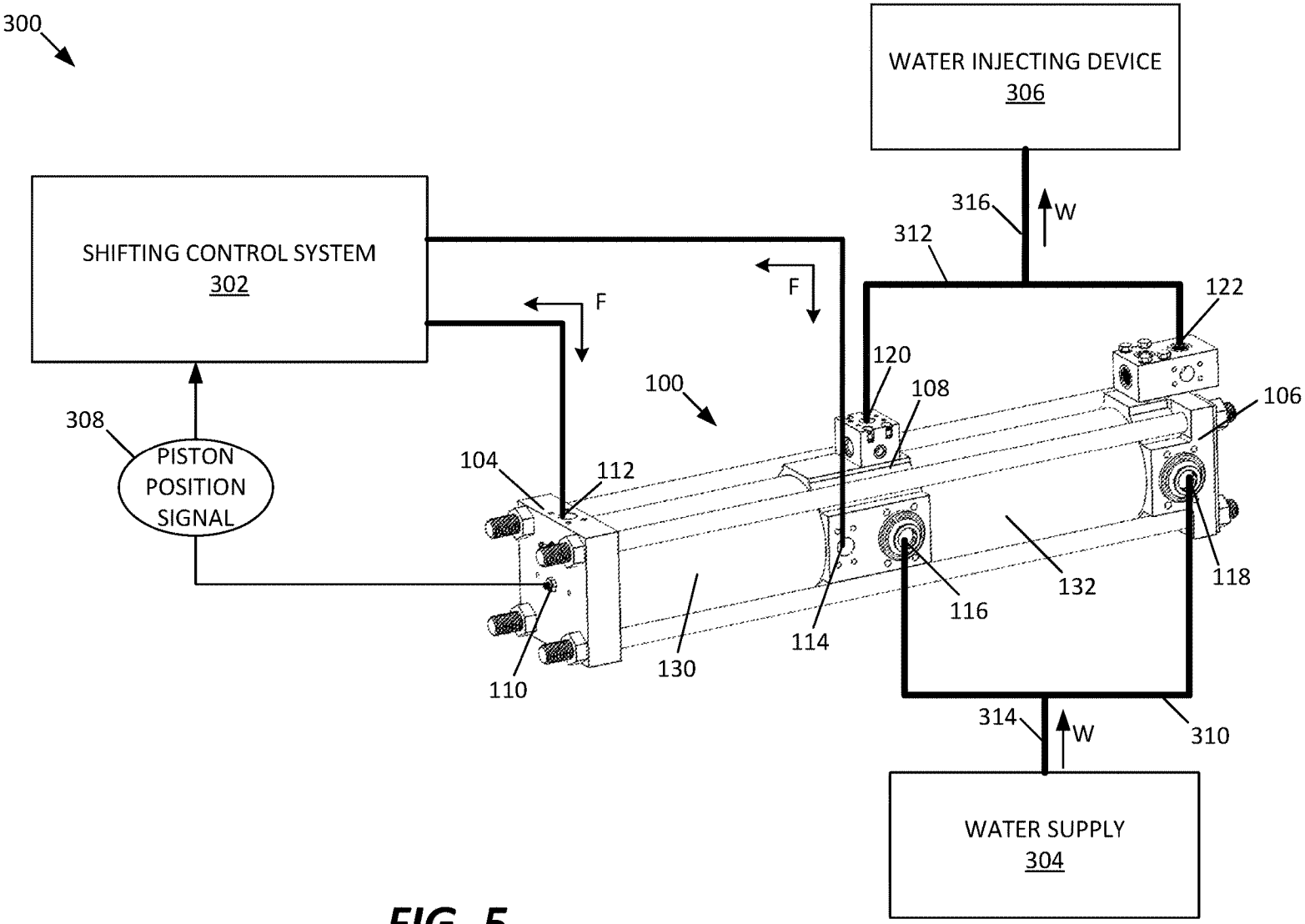
FIG. 5 illustrates an example water pump system using the displacement pump in accordance with the present disclosure.

In the illustrated example, the first piston head 154 moving within the first cylinder 134 is a driving piston actuated by hydraulic fluid (F) under pressure circulated by a shifting control system 302 (FIG. 5). Hydraulic fluid (F) is selectively circulated either from the first chamber 166 to the second chamber 168, or from the second chamber 168 to the first chamber 166, through the first hydraulic port 112, the shifting control system 302 (FIG. 5), and the second hydraulic port 114. For example, when hydraulic fluid (F) is drawn into the first chamber 166 through the first hydraulic port 112, the piston assembly 150 moves toward the second cylinder end head 106 (i.e., in the right direction) and hydraulic fluid (F) is discharged from the second chamber 168 through the second hydraulic port 114. Similarly, when hydraulic fluid (F) is drawn into the second chamber 168 through the second hydraulic port 114, the piston assembly 150 moves toward the first cylinder end head 104 (i.e., in the left direction) and hydraulic fluid (F) is discharged from the first chamber 166 through the first hydraulic port 112.

While the first piston head 154 operates as a driving piston, the second piston head 156 can be a water pumping piston. The second cylinder 136 receives water into the first and second chambers 170 and 172 through the first and second water inlet ports 116 and 118 (e.g., a water inlet manifold 310 (FIG. 5)). Water pumped by the second piston head 156 is discharged from the first and second chambers 170 and 172 of the second cylinder 136 through the first and second water outlet ports 120 and 122 (e.g., a water outlet manifold 312 (FIG. 5)). As further described in FIG. 5, the water inlet manifold 310 is in fluid communication with the first and second water inlet ports 116 and 118 and receives water from a water supply 304 through a conduit 314. The water outlet manifold 312 is in fluid communication with the first and second water outlet ports 120 and 122, and the water is discharged to a water injection device 306 (e.g., a nozzle) through the water outlet manifold 312 and a hose 316.

In some embodiments, check valves 188 are provided in the first water inlet port 116, the second water inlet port 118, the first water outlet port 120, and the second water outlet port 122. The check valves 188 can be spring-loaded to closed positions, and are arranged in the ports so that the valve 188 in the first water inlet port 116 will be closed as the piston assembly 150 is moved to the left-hand end of its stroke, while the valve 188 in the first water outlet port 120 will be open to discharge the water being pumped into the second chamber 172. At the same time the valve 188 in the second water inlet port 118 will be opened to admit water to the first chamber 170 (i.e., the right-hand side of the piston head 156), while the valve 177 in the second water outlet port 122 will be closed. The valves 188 are operated by pressure differentials, with the valves 188 in the first and second water inlet ports 116 and 118 opening on the suction stroke, closing on the pressure stroke, and with the valves 188 in the first and second water outlet ports 120 and 122 closing on the suction stroke and opening on the pressure stroke. These valves 188, therefore, alternately admit water from the water supply 304 to opposite sides of the second piston head 156 and alternately discharge the water on the pressure stroke of the second piston head 156, with one of the valves 188 in the water inlet ports 116 and 118 being opened on one side of the second piston head 156 (i.e., one of the first and second chambers 170 and 172) and one of the valves 188 in the water outlet ports 120 and 122 being opened on the opposite side of the second piston head 156 (i.e., the other of the first and second chamber 170 and 172) at the same time, while the other two valves 188 are closed.

With continued reference to FIGS. 1-3, the displacement pump 100 further includes a piston position sensor assembly 110. The piston position sensor assembly 110 is configured to detect a linear displacement or position of the piston assembly 150 within the cylinder body assembly 102. In the illustrated example, a position of the piston assembly 150 (e.g., the first piston head 154) adjacent the first cylinder end head 104 can be primarily considered in implementing a shifting control system 302 as illustrated in FIG. 5. In other examples, the piston position sensor assembly 110 can be used to detect different positions of the piston assembly 150 within the cylinder body assembly 102.

In some embodiments, the piston position sensor assembly 110 can include a linear variable differential transducer (LVDT). In this document, the piston position sensor assembly 110 can also be referred to as the linear variable differential transducer or linear variable differential transformer 110. The LVDT operates to convert a position or linear displacement from a mechanical reference into a proportional electrical signal containing phase (for direction) and amplitude (for distance) data. The linear variable differential transducer 110 can include a coil assembly 190 and a probe assembly 192.

The coil assembly 190 defines a probe through-hole 194 through which the probe assembly 192 moves. The coil assembly 190 is secured to the piston assembly 150 such that the probe through-hole 194 is aligned with the rod hole 180 of the piston rod 152. In some embodiments, the coil assembly 190 is attached to the piston rod 152 adjacent the open end 182 of the rod hole 180 so that the probe through-hole 194 is in communication with the rod hole 180. The coil assembly 190 can be fixed to the piston rod 152 in various manners.

In some embodiments, the probe assembly 192 includes a probe head 196 and a probe rod 198.

The probe head 196 is mounted to the first cylinder end head 104. In the illustrated example, the probe head 196 is secured to the first cylinder end head 104 along the longitudinal axis A. The probe head 196 can be secured to the first cylinder end head 104 in various manners. For example, the first cylinder end head 104 has a screw hole 200 along the longitudinal axis A, and the probe head 196 can be threadedly engaged into the screw hole 200 of the first cylinder end head 104. A sealing element can be disposed between the probe head 196 and at the first cylinder end head 104 (e.g., the screw hole 200) to sealingly attach the probe assembly 192 to the cylinder body assembly 102.

The probe rod 198 axially extends from the probe head 196 along the longitudinal axis A and is configured to be inserted into the rod hole 180 of the piston rod 152 through the probe through-hole 194 of the coil assembly 190. In some embodiments, the probe head 196 is integrally formed with the probe rod 198. The probe rod 198 can be cylindrically shaped and include a portion made of ferromagnetic material that functions as a ferromagnetic core sliding through the coil assembly 190 (e.g., the probe through-hole 194) along the longitudinal axis A. The probe rod 198 does not contact the inner surface of the rod hole 180 of the piston rod 152 as the piston assembly 150 moves along the longitudinal axis A.

The LVDT 110 uses electromagnetic coupling between the coil assembly 190 and the probe assembly 192 and does not require an electrical contact therebetween. The coil assembly 190 and the probe assembly 192 cooperate to detect a linear displacement or position of the piston assembly 150 within the cylinder body assembly 102. The principles and operations of the LVDT 110 are generally known. By way of example, the coil assembly 190 has three solenoidal coils placed end-to-end. A coil at the center is a primary coil, and the other two outer coils are top and bottom secondary coils. The probe rod 198 of the probe assembly 192 includes a ferromagnetic portion that slides through the probe through-hole 194 along the longitudinal axis A. An alternating current drives the primary coil and causes a voltage to be induced in each secondary coil proportional to the length of the ferromagnetic portion of the probe rod 198 linking to the secondary coil. As the probe rod 198 (e.g., the ferromagnetic portion thereof) moves, the primary coil's linkage to the two secondary coils changes and causes the induced voltages to change. The coils are connected so that an output voltage is a difference between the top secondary voltage and the bottom secondary voltage. A position or linear displacement of the piston rod 198 (e.g., the ferromagnetic portion thereof) relative to the coil assembly 190 (or vice versa) can be determined based upon the output voltage from the coils.

An example method of controlling the piston assembly 150 within the cylinder body assembly 102 using the piston position sensor assembly 110 is illustrated and described in more detail with reference to FIGS. 5-11.

Figure 4:
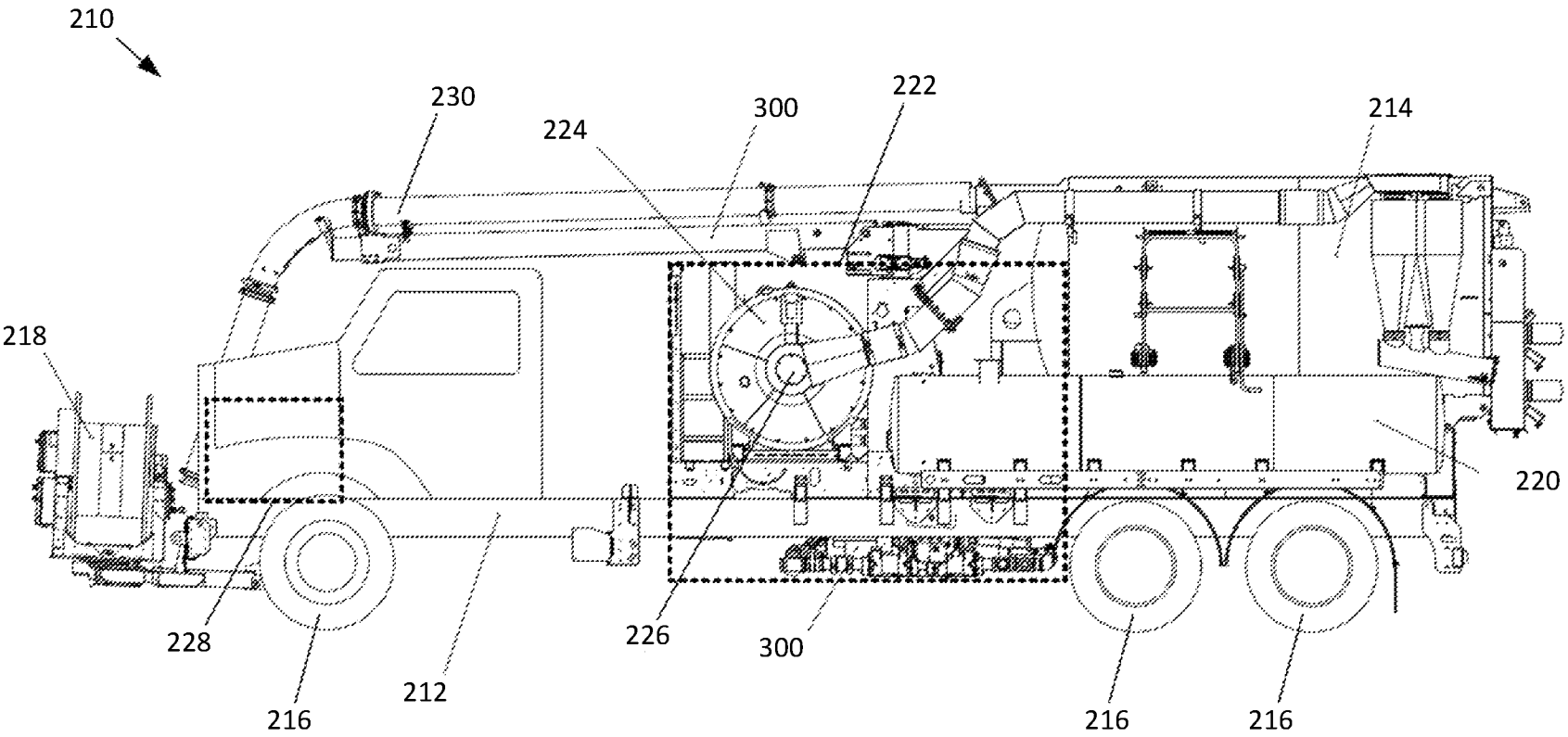
FIG. 4 is a side view of an example debris collection vehicle that may employ the displacement pump of FIG. 1.

FIG. 4 is a side view of an example debris collection vehicle 210 that may employ the displacement pump 100 in accordance with the principles of the present disclosure. In this example, the debris collection vehicle 210 is a sewer cleaning vehicle. In some embodiments, the vehicle 210 includes a chassis 212, a debris collection tank 214, wheels 216, a hose reel 218, water tanks 220, and a fan drive system 222 including a fan assembly 224 and an air inlet 226. The vehicle 210 can also include a power delivery system having a chassis or primary power system 228, which may be an internal combustion engine. The vehicle 210 may also be provided with an optional auxiliary power system. The primary power system 228 provides power for both the driving and non-driving functions of the vehicle 210. Examples of driving functions that require power are the vehicle drive train, the steering system, and the braking system. Examples of non-driving functions associated with the vehicle 210 are pumps and motors relating to the debris collection process. The vehicle 210 is also shown as including a water pump system 300 that can be powered by the primary power system 228, or optionally, an auxiliary power system. The fan drive system 222 is connected to the debris collection tank 214 such that debris can be collected by a suction hose 230 that is also connected to the debris collection tank 214.

FIG. 5 illustrates an example water pump system 300 using the displacement pump 100 in accordance with the present disclosure. In addition to the displacement pump 100, the water pump system 300 can include a shifting control system 302, a water supply 304, and a water injecting device 306. Also shown are a piston position signal 308, a water inlet manifold 310, and a water outlet manifold 312.

The shifting control system 302 operates the piston assembly 150 by selectively providing pressurized hydraulic fluid (F) through either the first hydraulic port 112 or the second hydraulic port 114. Further, the shifting control system 302 receives a piston position signal 308 from the piston position sensor assembly 110 to control a shifting trigger position of the piston assembly 150 at which the piston assembly 150 begins its shifting action (e.g., begins to change its direction of movement) within the cylinders 134 and 136. As described below, the shifting control system 302 is configured to adjust the shifting trigger position of the piston assembly 150 to maximize a stroke length of the piston assembly 150 while preventing the piston head 154 and 156 from hitting the cylinder end heads 104 and 106 or the base portions 138 and 140 of the intermediate cylinder head 108. An example shifting control system 302 is illustrated and described in more detail with reference to FIG. 6.

The water supply 304 operates to supply water (W) into the second cylinder 136 through the first and second water inlet ports 116 and 118. The water supply 304 can include the water tanks 220. The water inlet manifold 310 is in fluid communication with the first and second water inlet ports 116 and 118 and receives water from the water supply 304 through a conduit 314.

The water injecting device 306 operates to receive water (W) pumped by the displacement pump 100 and inject the water to a desired place. In some embodiments, the water injecting device 306 includes a nozzle assembly. The water outlet manifold 312 is in fluid communication with the first and second water outlet ports 120 and 122 of the displacement pump 100, and the water is discharged to the water injecting device 306 through the water outlet manifold 312 and a hose 316.

Figure 6:
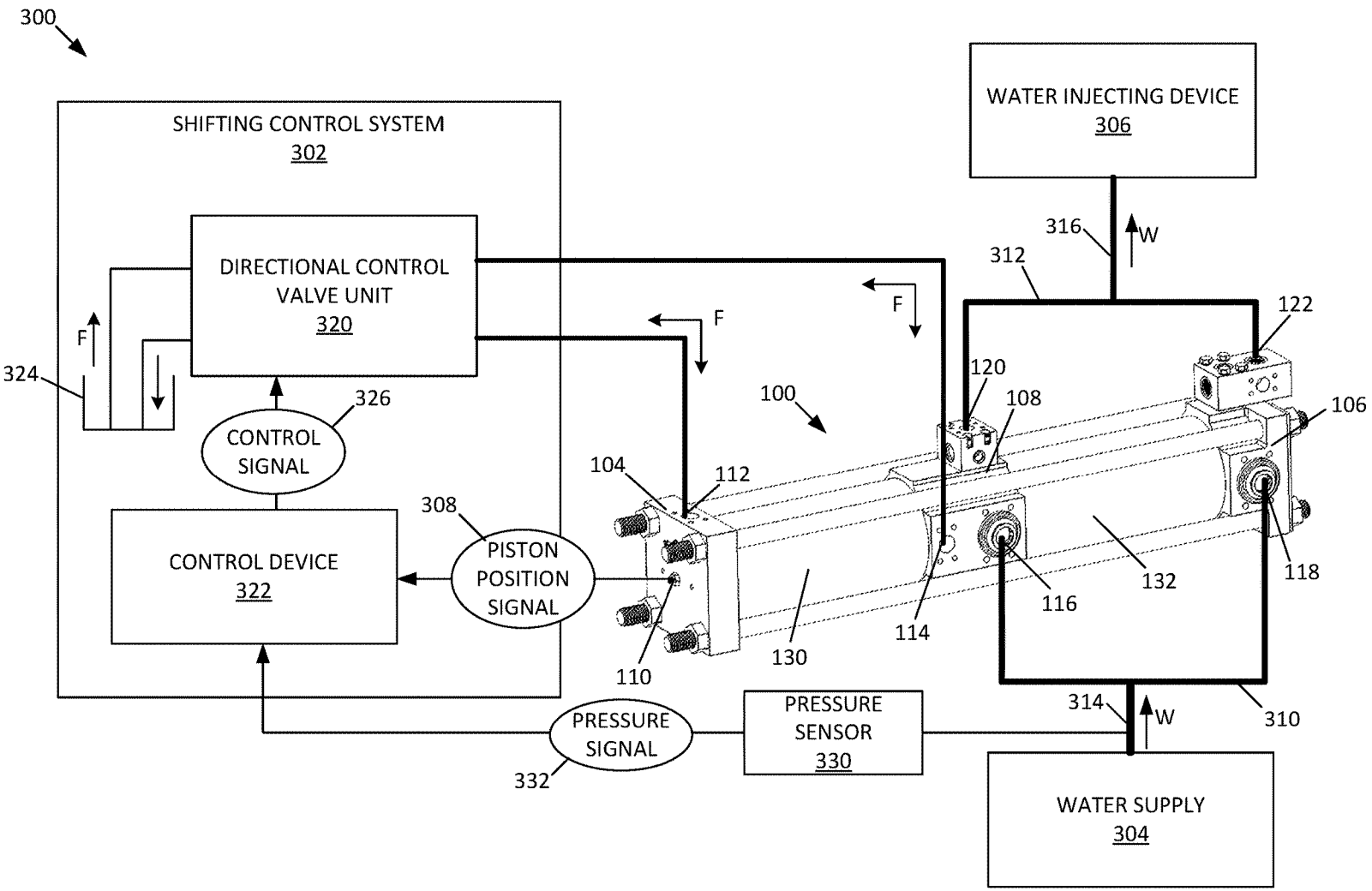
FIG. 6 illustrates an example shifting control system of FIG. 5.

FIG. 6 illustrates an example shifting control system 302 of FIG. 5. In some embodiments, the shifting control system 302 includes a directional control valve unit 320 and a control device 322.

The directional control valve unit 320 controls the axial, reciprocating movement of the piston assembly 150 by selectively providing pressurized hydraulic fluid (F) through either the first hydraulic port 112 or the second hydraulic port 114. The directional control valve unit 320 is in fluid communication with at least one reservoir (e.g., hydraulic fluid source) 324 that contains hydraulic fluid (F) to be supplied to the directional control valve unit 320. Based upon a control signal 326, the directional control valve unit 320 operates to shift a direction of movement of the piston assembly 150 in opposite directions within the cylinders 134 and 136.

The directional control valve unit 320 can be configured in various manners. In some embodiments, the directional control valve unit 320 includes one or more valve elements that are operated mechanically, hydraulically, and/or by solenoid. For example, the directional control valve unit 320 can include a variable displacement pump and/or a variable speed engine that are actuated by the primary power system 228 or the auxiliary power system of the vehicle 210.

The control device 322 operates to receive the piston position signal 308 from the piston position sensor assembly 110 and send the control signal 326 to the directional control valve unit 320. The control signal 326 is used by the directional control valve unit 320 to control a shifting action of the piston assembly 150 so that the piston assembly 150 changes its direction of movement along the longitudinal axis A within the cylinders 134 and 136. The piston position signal 308 can include one or more output voltage differentials generated in the piston position sensor assembly 110 due to the movement of the piston assembly 150 (i.e., the coil assembly 190) relative to the probe assembly 192. Example operations of the control device 322 are illustrated and described in more detail with reference to FIGS. 7-11.

With continued reference to FIG. 6, some examples of the water pump system 300 can include a pressure sensor 330 configured to monitor a water pressure generated by the displacement pump 100. The pressure sensor 330 sends a pressure signal 332 to the control device 322 so that the control device 322 can use the pressure signal 332 for various purposes.

In some embodiments, the control device 322 can use the pressure signal 332 to monitor a water pressure of the displacement pump 100 and control the water pressure as necessary based upon the monitored water pressure in combination of a piston shifting differential and/or a piston travel speed (or a flow rate change) that are obtained from the piston position signal 308 as illustrated in FIGS. 7-11.

Referring to FIGS. 7-11, example operations of the shifting control system 302 in accordance with the principles of the present disclosure. In this document, the term, a "shifting target position" or "target shifting position," which can be referred to as a target dead center, indicates a point, position, or timing at which the piston assembly 150 (e.g., one of the piston heads 154 and 156) is intended to shift (i.e., momentarily stop and begin to change its movement in an opposite direction) to achieve a maximum possible stroke length while minimizing electrical, mechanical, and hydraulic damages to the entire system. The terms, a "shifting start position," "shifting trigger position," and "shifting trigger point," indicate a point, position, or timing at which the piston assembly 150 (e.g., one of the piston heads 154 and 156) is preset to begin to shift its direction of movement. As described herein, the piston assembly 150 does not usually shift at the shifting trigger position due to several factors, such as different flow rates, varied ambient temperatures, and system response delays. The term, an "actual shifting position," indicates a point, position, or timing of the piston assembly 150 (e.g., the piston heads 154 and 156) where the piston assembly 150 actually stops and shifts its movement in the opposite direction within the cylinders 134 and 136.

As described below, the control device 322 operates to maximize a stroke length of the piston assembly 150 (e.g., the piston heads 154 and 156) while the piston heads 154 and 156 do not hit the cylinder bodies 130 and 132, by adjusting a shifting trigger position such that an actual shifting position of the piston heads 154 and 156 is located as close as possible to the cylinder end heads 104, 106 and 108. It is important to note that the shifting control system 302 and the displacement pump 100 typically include many components or factors that can cause changes in shifting positions of the piston assembly 150 over a plurality of cycles. For example, a change in ambient temperature can lead to change in the viscosity of hydraulic fluid (F) (e.g., a low temperature in cold weather can increase fluid viscosity), thereby affecting the shifting position of the piston assembly 150 within the cylinder body assembly 102. Further, the directional control valve unit 320 of the shifting control system 302 includes several elements, such as hydraulic valves, solenoids, and relays, which can cause response delay in operation of the piston assembly 150. These elements can make it difficult to accurately control the position of the piston assembly 150 and consistently maintain shifting positions of the piston assembly 150 in each stroke. As illustrated with reference to FIGS. 7-11, the control device 322 is configured to accurately adjust the shifting trigger positions of the piston assembly 150 as desired in each stroke. The control device 322 does not require manual setups, configurations, and/or adjustments, and can automatically control the displacement pump 100 to maximize the stroke length of the piston assembly 150 regardless of different flow rates, varied ambient temperatures, response delays in several components, and any other factors that prohibit the most efficient shifting position of the piston assembly 150 in the displacement pump 100. As a result, the displacement pump 100 and the shifting control system 302 can have a prolonged life and increase fuel efficiency.

Figure 7:
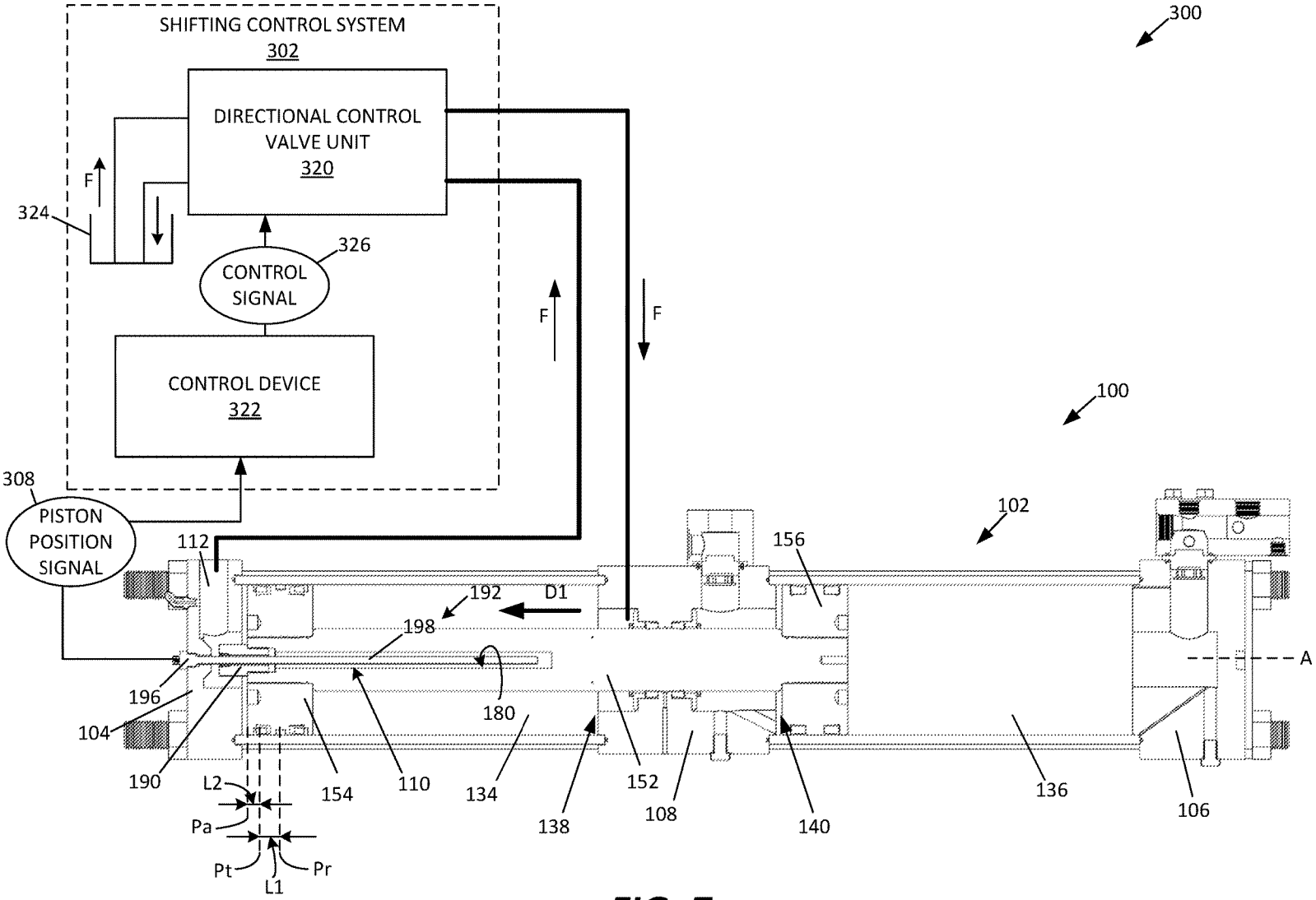
FIG. 7 illustrates an example operation of the shifting control system for the displacement pump in the water pump system based upon a piston shifting differential.
Figure 8:
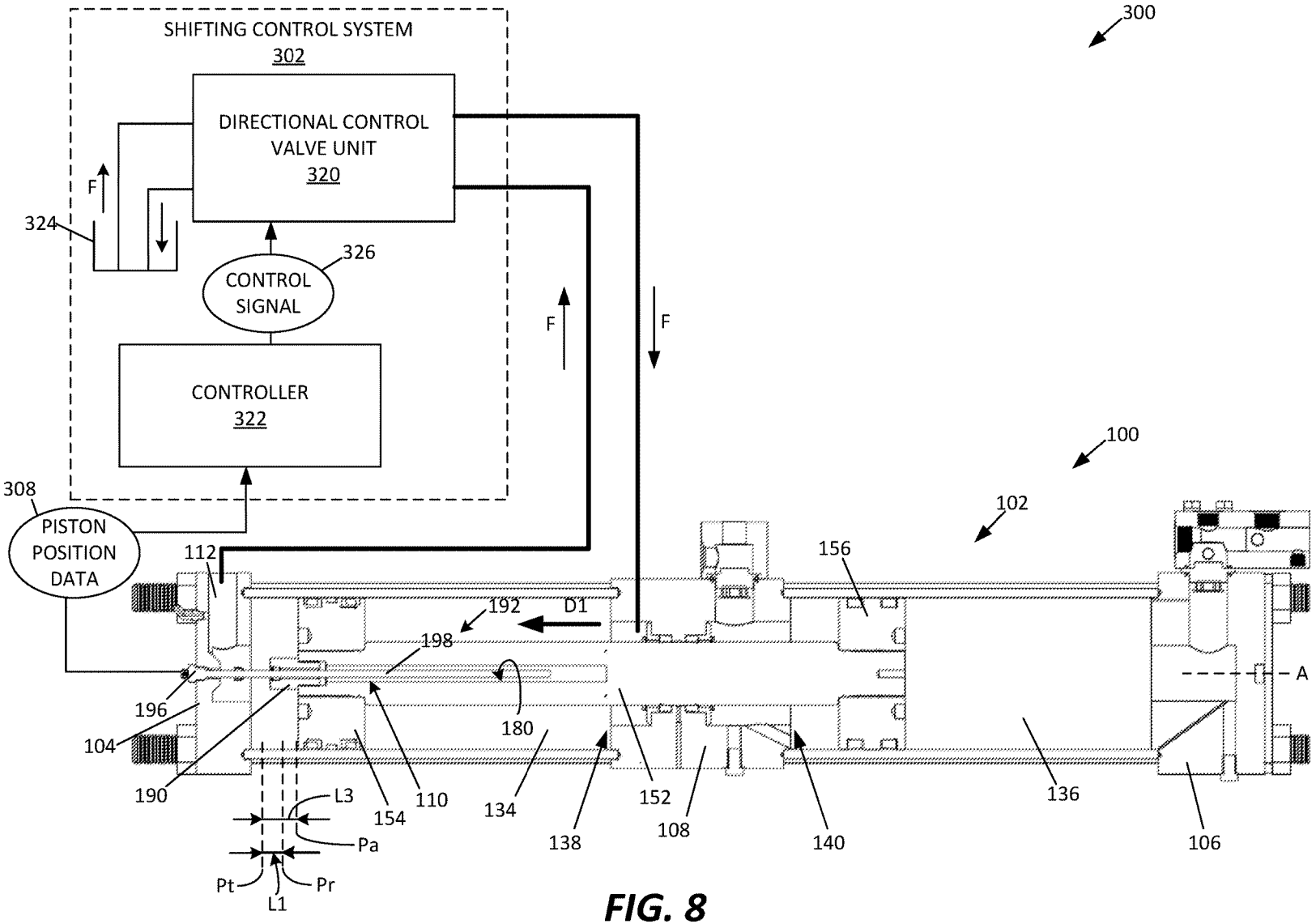
FIG. 8 illustrates the operation of the shifting control system in a different situation.
Figure 9:
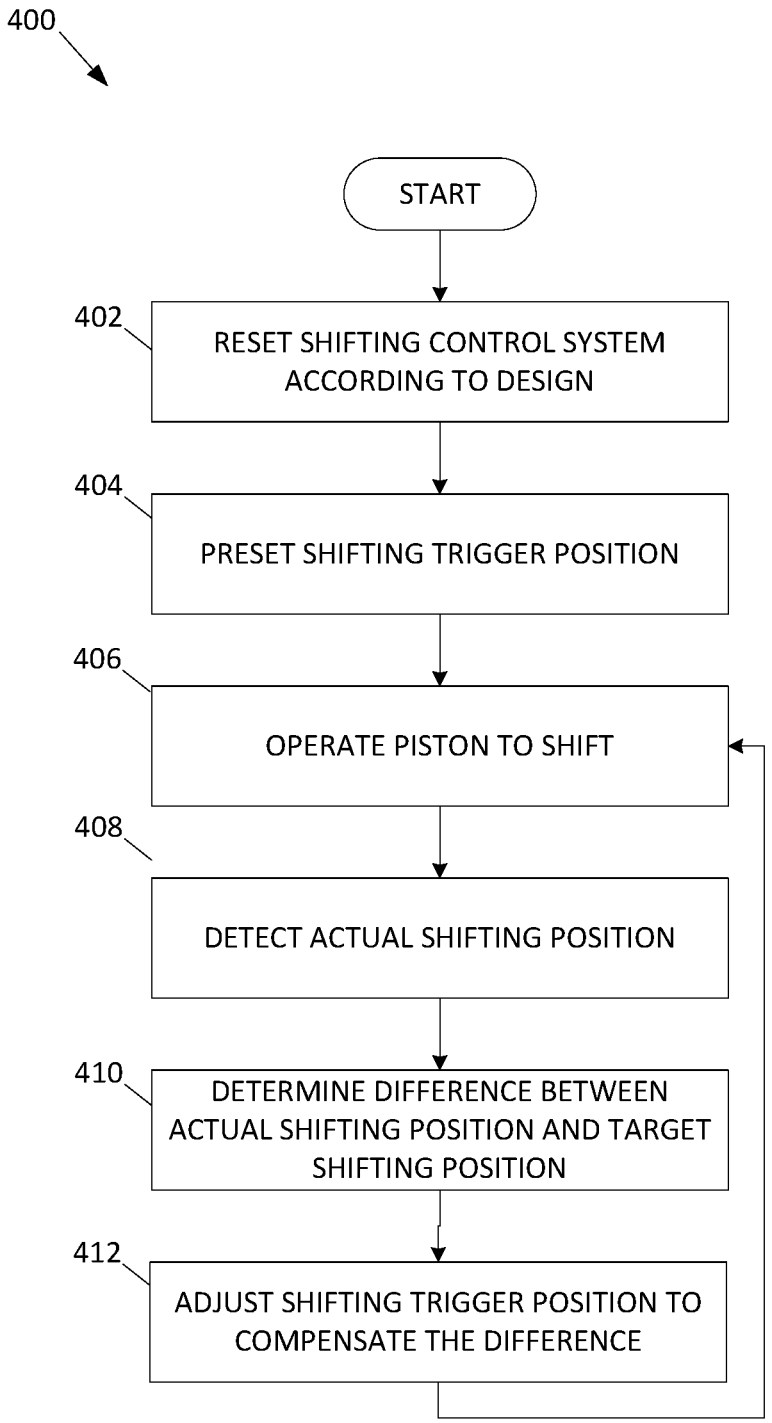
FIG. 9 is a flowchart illustrating an example method of operating the shifting control system as illustrated in FIGS. 8 and 9.

With reference to FIGS. 7-9, a first example operation of the shifting control system 302 in accordance with the present disclosure. In particular, FIG. 7 illustrates an example operation of the shifting control system 302 for the displacement pump 100 in the water pump system 300 based upon a piston shifting differential, and FIG. 8 illustrates the operation of the shifting control system 302 in a different situation.

In FIGS. 7 and 8, it is primarily described that the control device 322 is operated when the first piston head 154 is located adjacent the first cylinder end head 104 and the second piston head 156 is located adjacent the intermediate cylinder head 108 (i.e., the second base portion 140). However, the same principles and operations can apply when the first piston head 154 is located adjacent the intermediate cylinder head 108 (i.e., the first base portion 138) and the second piston head 156 is located adjacent the second cylinder end head 106.

Referring to FIGS. 7 and 8, the control device 322 is first provided with a target shifting position (Pt) at which the piston assembly 150 maximizes its stroke length within the cylinders 134 and 136. The target shifting position (Pt) is determined as a position at which the piston assembly 150 shifts its direction of movement with a longest possible stroke length while the first piston head 154 and the second piston head 156 would never, or least likely, hit the first cylinder end head 104 and the intermediate cylinder head 108 (i.e., the second base portion 140), respectively. The target shifting position (Pt) can vary depending on the design of the displacement pump 100. In some embodiments, the target shifting position (Pt) is determined independently from the control device 322 and provided to the control device 322. In other embodiments, the control device 322 is configured to calculate the target shifting position (Pt) based upon several configuration data.

Second, the control device 322 is provided with a shifting trigger position (Pr) at which the piston assembly 150 is preset to begin shifting (i.g., begin to change its direction of movement within the cylinders 134 and 136). The control device 322 generates a control signal 326 based upon the shifting trigger position (Pr), and the directional control valve unit 320 receives the control signal 326 to control an axial movement of the piston assembly 150 to change in the opposite direction along the longitudinal axis A.

In some embodiments, the shifting trigger position (Pr) is determined to be located before the target shifting position (Pt) in a subject stroke. In the illustrated example, as the piston assembly 150 moves in a first direction (D1) (e.g., the left-hand direction in the Figure), the shifting trigger position (Pr) is located on the right side of the target shifting position (Pt). For example, the shifting trigger position (Pr) is spaced apart a first distance (L1) from the target shifting position (Pt). In the illustrated example of FIG. 7, the first distance (L1) can be determined to be a distance over which the first piston head 154 would least likely to travel to hit the first cylinder end head 104 past the target shifting position (Pt). In some embodiments, the harshest operating condition of the displacement pump 100 and the shifting control system 302 is considered from all possible situations that can cause, for example, the largest system response delay. The maximum flow rate permitted in the displacement pump 100, which operates the piston assembly 150 in the highest speed, can also be considered to calculate the first distance (L1).

The control device 322 then operates to detect an actual shifting position (Pa) at which the piston assembly 150 has actually shifted its movement in an opposite direction near the cylinder end head 104 in the subject stroke. The piston position sensor assembly 110, such as a linear variable displacement transducer (LVDT), is used as described above to detect the actual shifting position (Pa). The control device 322 receives the piston position signal 308 from the piston position sensor assembly 110 and can use the signal 308 to calculate the actual shifting position (Pa).

As described, the actual shifting position (Pa) can be different from the shifting trigger position (Pr) that has been preset by the shifting control system 302, due to several factors, such as different flow rates, varied ambient temperatures, and system response delays, as illustrated above. The actual shifting position (Pa) can also be different from the target shifting position (Pt).

In FIG. 7, the piston assembly 150 moves overshot so that the actual shifting position (Pa) passes the target shifting position (Pt). Receiving the piston position signal 308 from the piston position sensor assembly 110, the control device 322 determines a distance (L2) between the target shifting position (Pt) and the actual shifting position (Pa) and use the distance (L2) to calculate a new shifting trigger position (or a new shifting trigger point or timing) at which the directional control valve unit 320 operates to shift the direction of movement of the piston assembly 150. In some embodiments, the control device 322 sends a control signal 326 at the new shifting trigger position in the next cycle so that the directional control valve unit 320 operates the piston assembly 150 to change its axial movement in the opposite direction at the new shifting trigger point. In the example of FIG. 7 where the piston assembly 150 moves overshot, the new shifting trigger point is set to advance the original shifting trigger point such that the directional control valve unit 320 changes the direction of movement of the piston assembly 150 earlier than the last cycle to compensate for the overshoot of the piston assembly 150. The new shifting trigger point can be calculated by adding the difference in distance (L2) to the original shifting trigger point.

In FIG. 8, the piston assembly 150 moves undershot so that the actual shifting position (Pa) falls short of the target shifting position (Pt). Receiving the piston position signal 308 from the piston position sensor assembly 110, the control device 322 determines a distance (L3) between the target shifting position (Pt) and the actual shifting position (Pa) and use the distance (L3) to calculate a new shifting trigger point (or a new shifting trigger position or timing) at which the directional control valve unit 320 operates to shift the direction of movement of the piston assembly 150. In some embodiments, the control device 322 sends a control signal 326 at the new shifting trigger point in the next cycle so that the directional control valve unit 320 operates the piston assembly 150 to shift its axial directional movement at the new shifting trigger point. In the example of FIG. 8 where the piston assembly 150 moves undershot, the new shifting trigger point is set to delay the original shifting trigger point such that the directional control valve unit 320 changes the direction of movement of the piston assembly 150 later than the last cycle to compensate for the undershoot of the piston assembly 150. The new shifting trigger point can be calculated by subtracting the difference in distance (L3) from the original shifting trigger point.

As such, when the actual shifting position (Pa) of the piston assembly 150 is detected to be different from the target shifting position (Pt), the trigger point for the next cycle is adjusted based upon the distance between the actual shifting position (Pa) and the target shifting position (Pt). In the subsequent cycle, the new trigger point enables the directional control valve unit 320 to operate to compensate for the differential found in the previous cycle.

The adjustment of trigger point can be repeatedly performed in every cycle. The differential between the actual shifting position (Pa) and the target shifting position (Pt)

results from a combination of several factors (e.g., different flow rates, varied ambient temperatures, and system response delays) in the entire system (including the displacement pump 100 and the shifting control system 302), and, therefore, the adjustment of trigger point can take account of all of such factors at the same time. Accordingly, the shifting control system 302 can automatically adjust a shifting trigger point of the piston assembly 150 to achieve a maximum possible stroke length while minimizing electrical, mechanical, and hydraulic damages to the entire system.

FIG. 9 is a flowchart illustrating an example method 400 of operating the shifting control system 302. The method 400 can be implemented in the shifting control system 302 as illustrated in FIGS. 7 and 8.

At operation 402, the shifting control system 302 is reset based upon its design. In this operation, the shifting control system 320 can operate to select the target shifting position (Pt). As described above, the target shifting position (Pt) is a position at which the piston assembly 150 changes its movement in the opposite direction within the cylinder body assembly 102 to achieve a maximum stroke length while preventing the piston assembly 150 from hitting any of the cylinder end heads 104, 106 and 108 to minimize damages to the entire water pump system 300.

At operation 404, the shifting control system 302 operates to preset the shifting trigger position (Pr). In some embodiments, the shifting trigger position (Pr) is determined to be located before the target shifting position (Pt) in a subject stroke.

At operation 406, the shifting control system 302 operates to control the piston assembly 150 to shift (i.e., to change its direction of movement within the cylinder body assembly 102) according to the shifting trigger position (Pr). For example, the control device 322 is configured to generate a control signal 326 at a preset point or timing such that the piston assembly 150 begins its shifting at the shifting trigger position (Pr). The directional control valve unit 320 receives the control signal 326 at the preset point and, based upon the control signal 326, operates the piston assembly 150 to change an axial movement in the opposite direction along the longitudinal axis A at the shifting trigger position (Pr). When the control device 322 sends the control signal 326 for operation of the directional control valve unit 320 at the preset trigger point, the piston assembly 150 is intended to change its movement in an opposite direction at the shifting trigger position (Pr). As described above, however, the actual shifting position (Pa) is not necessarily identical to the shifting trigger position (Pr) for various reasons.

At operation 408, the shifting control system 302 detects the actual shifting position (Pa) of the piston assembly 150 through the piston position sensor assembly 110.

At operation 410, the shifting control system 302 operates to determine a difference (L2, L3) between the actual shifting position (Pa) and the target shifting position (Pt).

At operation 412, the shifting control system 302 operates to adjust the operation of the displacement pump 100 to compensate for the difference. In some embodiments, the shifting control system 302 adjusts a shifting trigger point for the next cycle based upon the distance between the actual shifting position (Pa) and the target shifting position (Pt). In the subsequent cycle, the new shifting trigger point enables the shifting control system 302 to operate the displacement pump 100 (e.g., to change a direction of movement of the piston assembly 150) at the adjusted trigger point, to compensate for the differential found in the previous cycle.

Once the operation 412 is done, the method 400 returns to the operation 406 and repeats the subsequent operations in each cycle of piston movement. In some embodiments, the method 400 can be performed until the water pump system 300 is turned off.

Figure 10:
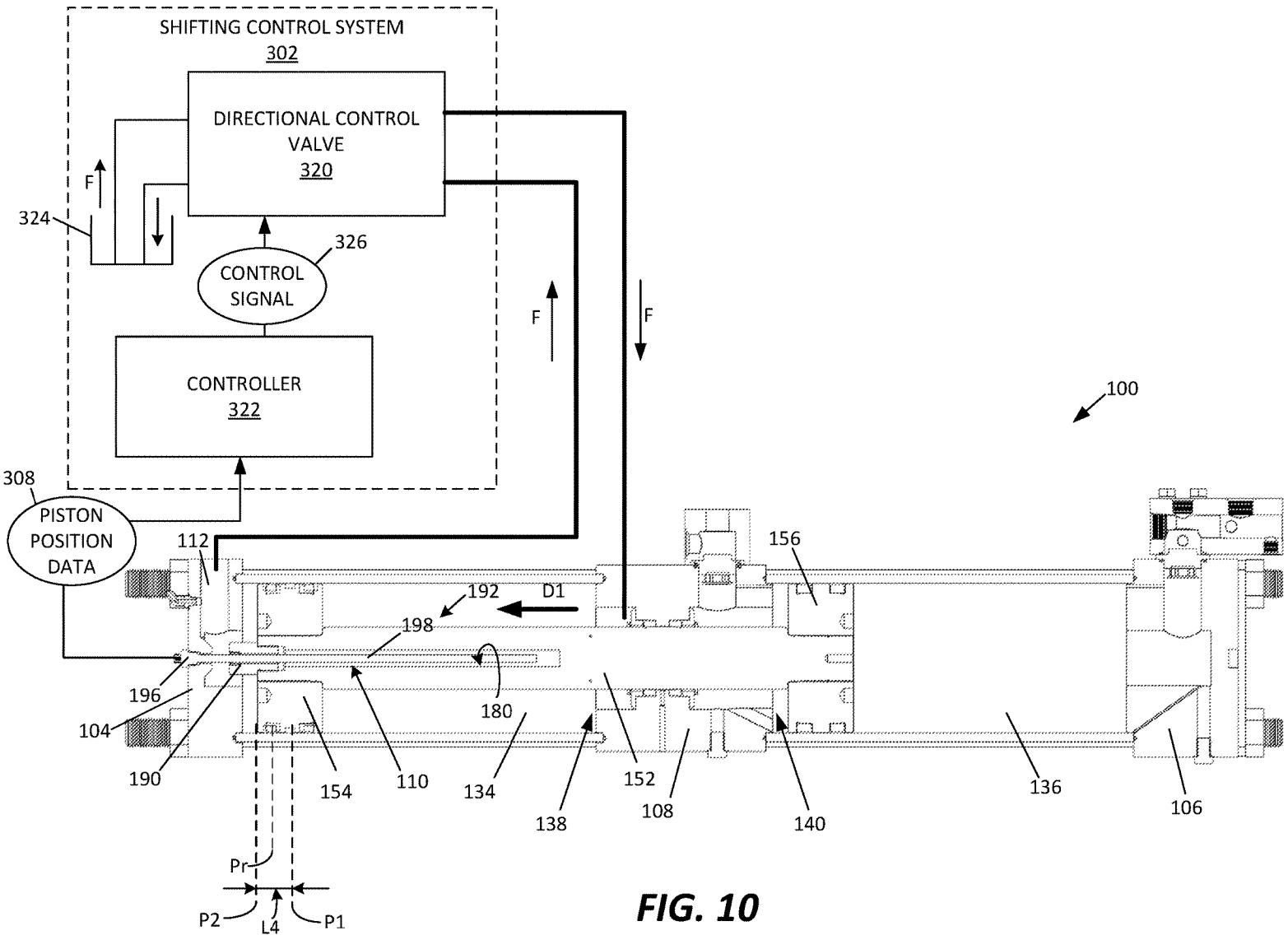
FIG. 10 illustrates an example operation of the shifting control system for the displacement pump in the water pump system based upon a piston travel speed.
Figure 11:
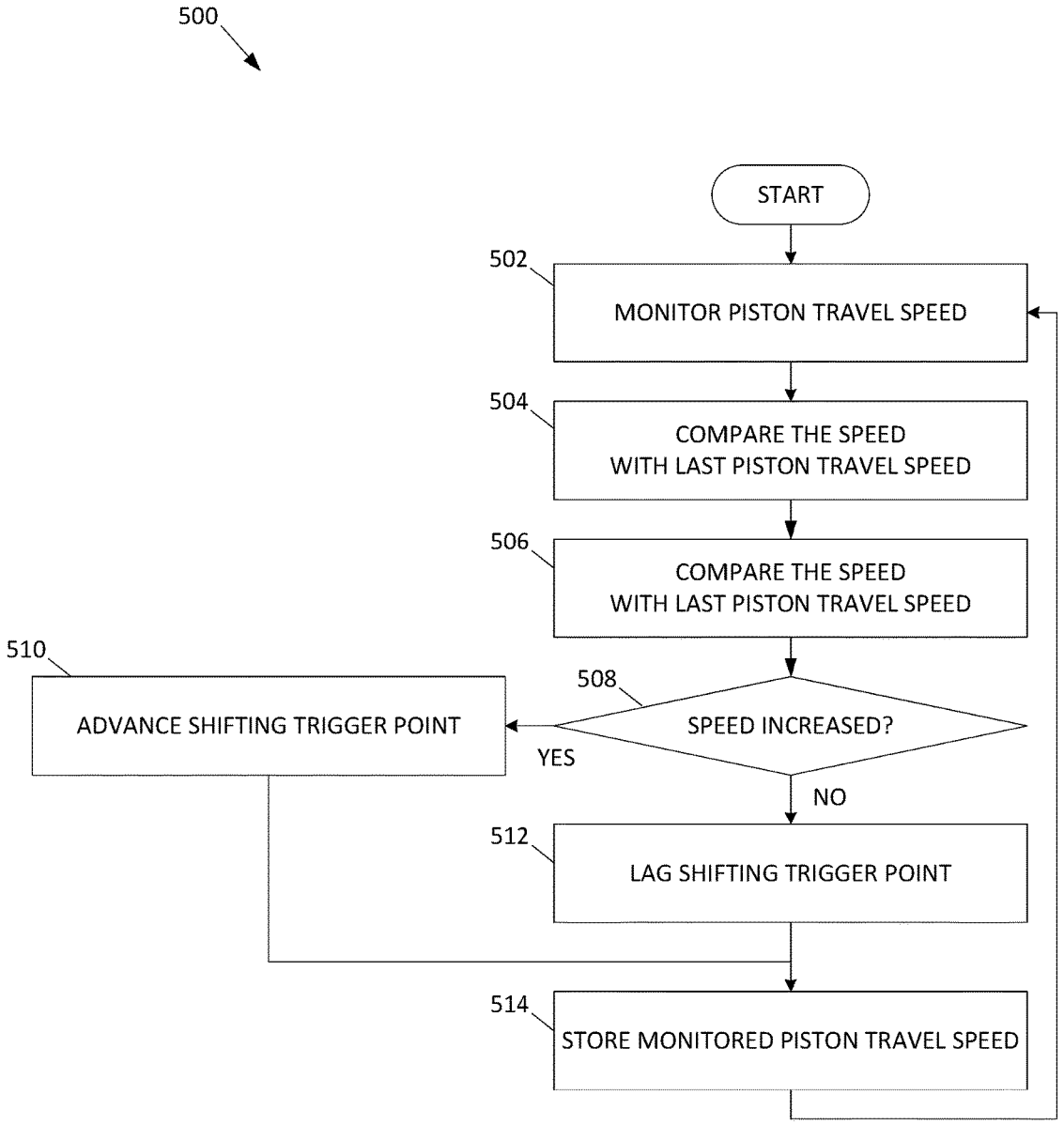
FIG. 11 is a flowchart illustrating an example method of operating the shifting control system as illustrated in FIG. 10.

With reference to FIGS. 10 and 11, a second example operation of the shifting control system 302 in accordance with the present disclosure. In particular, FIG. 10 illustrates an example operation of the shifting control system 302 for the displacement pump 100 in the water pump system 300 based upon a piston travel speed (also referred to herein as a flow rate change).

In this example, the shifting control system 302 monitors a change in a speed of the piston assembly 150 (and thus a flow rate in the cylinder) in each cycle and adjust a trigger point (or a trigger timing) to avoid an overshoot of the piston assembly 150 resulting from the increase in flow rate and/or an undershoot of the piston assembly 150 resulting from the decrease in flow rate. As shown below, the speed of the piston assembly 150 can be detected near at least one of the cylinder end heads 104, 106 and 108.

In FIG. 10, the control device 322 is described when the first piston head 154 is located adjacent the first cylinder end head 104 and the second piston head 156 is located adjacent the intermediate cylinder head 108 (i.e., the second base portion 140). However, the same principles and operations can apply when the first piston head 154 is located adjacent the intermediate cylinder head 108 (i.e., the first base portion 138) and the second piston head 156 is located adjacent the second cylinder end head 106.

Referring to FIG. 10, the control device 322 is provided with a shifting trigger position (Pr). The shifting trigger position (Pr) is determined adjacent the first cylinder end head 104. In some embodiments, the shifting trigger position (Pr) can be selected in the same manner as illustrated in FIGS. 7 and 8. Thus, the description for the shifting trigger position (Pr) in FIGS. 7 and 8 is incorporated by reference and omitted for brevity purposes in this example.

The control device 322 then operates to detect a speed of the piston assembly 150 as the first piston head 154 moves close to the shifting trigger position (Pr). In some embodiments, the control device 322 monitors a distance (L4) that the piston assembly 150 travels over a predetermined period of time (t). For example, the control device 322 can measure a linear displacement (L4) of the first piston head 154 from a first position (P1) to a second position (P2) along the longitudinal axis A. In some embodiments, the first position (P1) is selected prior to the shifting trigger position (Pr) in the first direction D (i.e., a direction in which the piston assembly 150 moves) to reduce a risk of the first piston head 154 hitting the first cylinder end head 104. In some embodiments, the predetermined period of time (t) can be about 0.075 second. Other periods of time (t) can be possible in different circumstances.

Once the speed of the piston assembly 150 is calculated, the control device 322 compares the current speed with a speed of the piston assembly 150 monitored at the same location in the last cycle. If the current speed is different than the last one, the control device 322 operates to adjust a shifting trigger position (Pr) of the piston assembly 150 in the subject cycle to make the shifting position (Pa) in the subject cycle to be substantially consistent with the shifting position (Pa) in the last cycle. For example, if the current speed is different from the last speed, the control device 322 operates to calculate a new trigger point (or a new trigger timing) such that, when actuated at the new trigger point, the directional control valve unit 320 operates to shift the direction of movement of the piston assembly 150 at the same shifting position as in the last cycle. In some embodiments, the control device 322 sends a control signal 326 at the new trigger point to the directional control valve unit 320 so that the directional control valve unit 320 operates the piston assembly 150 to change its axial movement in the opposite direction at substantially the same shifting position as in the last cycle.

If the current speed is found to be faster than the last one, the new trigger point is set to advance the original trigger point, and thus the directional control valve unit 320 changes the direction of movement of the piston assembly 150 earlier than the last cycle to compensate for the overshoot of the piston assembly 150.

If the current speed is determined to be slower than the last one, the new trigger point is set to delay the original trigger point, and thus the directional control valve unit 320 changes the direction of movement of the piston assembly 150 later than the last cycle to compensate for the undershoot of the piston assembly 150.

The control device 322 also operates to store the monitored speed (i.e., a monitored distance (L4) over a given time (t)) as a reference speed for the next cycle. The control device 322 can repeat the operations as described above with the stored reference speed.

FIG. 11 is a flowchart illustrating an example method 500 of operating the shifting control system 302. The method 500 can be implemented in the shifting control system 302 as illustrated in FIG. 10.

At operation 502, the shifting control system 302 operates to monitor a speed of the piston assembly 150 that travels near at least one of the cylinder end heads 104, 106 and 108. In some embodiments, the speed of the piston assembly 150 can be calculated from a linear displacement (i.e., a difference between the first and second positions (P1) and (P2)) and a given amount of time (t), as illustrated in FIG. 10.

At operation 504, the shifting control system 302 operates to compare the monitored speed with a speed of the piston assembly 150 obtained at or adjacent the same location in the last cycle.

At operation 506, the shifting control system 302 determines a difference between the current speed and the last speed.

At operation 508, the shifting control system 302 determines whether the current speed is greater than the last speed. If the current speed is faster than the last speed ("YES" at operation 508), the method 500 moves on to operation 510. Otherwise ("NO" at operation 508), the method 500 continues at operation 512.

At operation 510, the shifting control system 302 operates to set a next trigger point to advance a current trigger point so that the directional control valve unit 320 changes the direction of movement of the piston assembly 150 earlier than the last cycle to compensate for the overshoot of the piston assembly 150.

At operation 512, the shifting control system 302 operates to set a next trigger point to delay a current trigger point so that the directional control valve unit 320 changes the direction of movement of the piston assembly 150 later than the last cycle to compensate for the undershoot of the piston assembly 150.

At operation 514, the shifting control system 302 stores the monitored speed of the piston assembly 150 for use in the next cycle.

Once the operation 514 is done, the method 500 returns to the operation 502, and repeats the subsequent operations in each cycle as described above. In some embodiments, the method 500 can be performed until the water pump system 300 is turned off.

In some embodiments, the shifting control system 302 is configured to control the displacement pump 100 based upon either the shifting distance differential as illustrated in FIGS. 7-9 or the flow rate increase as illustrated in FIGS. 10-11. In other embodiments, the shifting control system 302 is configured to employ both of the piston shifting differential algorithm and the piston travel speed algorithm. A selective use of, or a combination of, these control algorithms can automatically adjust a shifting trigger position of the piston assembly 150 to match a target shifting position (or as close to the target shifting position as possible) in each cycle, thereby achieving a maximum stroke length, and prevents the piston assembly 150 from hitting any portions of the cylinder body assembly 102.

As described, the piston position sensor assembly 110 is configured as a non-moving element except that the coil assembly 190 moves together with a reciprocation of the piston assembly 150. In particular, the probe assembly 192 is designed as a non-moving part fixed to the cylinder body assembly 102. Further, the piston position sensor assembly 110 provides a contactless method of detecting a position of the piston assembly 150 within the cylinder body assembly 102. Therefore, the shifting control system 302 using the piston position sensor assembly 110 can reduce wear on associated mechanical components.

Figure 12:
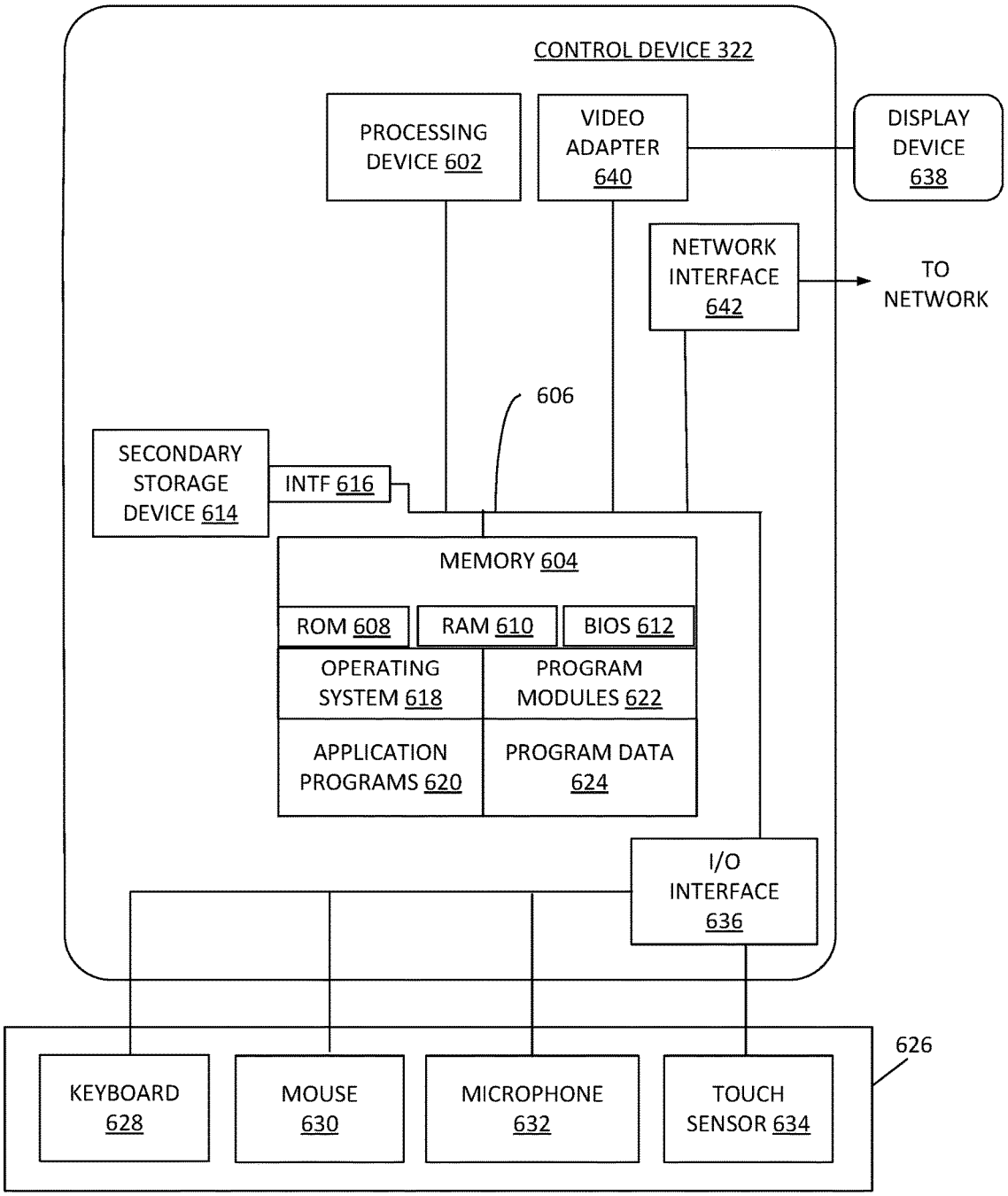
FIG. 12 illustrates an exemplary architecture of a computing device that can be used to implement aspects of the present disclosure, including a control device in accordance with the present disclosure.

FIG. 12 illustrates an exemplary architecture of a computing device that can be used to implement aspects of the present disclosure, including the control device 322. The computing device illustrated in FIG. 12 can be used to execute the operating system, application programs, and software modules (including the software engines) described herein. By way of example, the computing device will be described below as the control device 322. To avoid undue repetition, this description of the computing device will not be separately repeated herein for each of other computing devices that can be used in a water pump control system and/or the vehicle 210, but such devices can also be configured as illustrated and described with reference to FIG. 12.

The control device 322 includes, in some embodiments, at least one processing device 602, such as a central processing unit (CPU). A variety of processing devices are available from a variety of manufacturers, for example, Intel or Advanced Micro Devices. In this example, the control device 322 also includes a system memory 604, and a system bus 606 that couples various system components including the system memory 604 to the processing device 602. The system bus 606 is one of any number of types of bus structures including a memory bus, or memory controller; a peripheral bus; and a local bus using any of a variety of bus architectures.

Examples of computing devices suitable for the control device 322 include a desktop computer, a laptop computer, a tablet computer, a mobile computing device (such as a smart phone, an iPod® or iPad® mobile digital device, or other mobile devices), or other devices configured to process digital instructions.

The system memory 604 includes read only memory 608 and random access memory 610. A basic input/output system 612 containing the basic routines that act to transfer information within control device 322, such as during start up, is typically stored in the read only memory 608.

The control device 322 also includes a secondary storage device 614 in some embodiments, such as a hard disk drive, for storing digital data. The secondary storage device 614 is connected to the system bus 606 by a secondary storage interface 616. The secondary storage devices 614 and their associated computer readable media provide nonvolatile storage of computer readable instructions (including application programs and program modules), data structures, and other data for the control device 322.

Although the exemplary environment described herein employs a hard disk drive as a secondary storage device, other types of computer readable storage media are used in other embodiments. Examples of these other types of computer readable storage media include magnetic cassettes, flash memory cards, digital video disks, Bernoulli cartridges, compact disc read only memories, digital versatile disk read only memories, random access memories, or read only memories. Some embodiments include non-transitory media. Additionally, such computer readable storage media can include local storage or cloud-based storage.

A number of program modules can be stored in secondary storage device 614 or memory 604, including an operating system 618, one or more application programs 620, other program modules 622 (such as the software engines described herein), and program data 624. The control device 322 can utilize any suitable operating system, such as Microsoft Windows™, Google Chrome™, Apple OS, and any other operating system suitable for a computing device.

In some embodiments, a user provides inputs to the control device 322 through one or more input devices 626. Examples of input devices 626 include a keyboard 628, mouse 630, microphone 632, and touch sensor 634 (such as a touchpad or touch sensitive display). Other embodiments include other input devices 626. The input devices are often connected to the processing device 602 through an input/output interface 636 that is coupled to the system bus 606. These input devices 626 can be connected by any number of input/output interfaces, such as a parallel port, serial port, game port, or a universal serial bus. Wireless communication between input devices and the interface 636 is possible as well, and includes infrared, BLUETOOTH® wireless technology, 802.11a/b/g/n, cellular, or other radio frequency communication systems in some possible embodiments.

In this example embodiment, a display device 638, such as a monitor, liquid crystal display device, projector, or touch sensitive display device, is also connected to the system bus 606 via an interface, such as a video adapter 640. In addition to the display device 638, the control device 322 can include various other peripheral devices (not shown), such as speakers or a printer.

When used in a local area networking environment or a wide area networking environment (such as the Internet), the control device 322 is typically connected to a data communications network through a network interface 642, such as an Ethernet interface. Other possible embodiments use other communication devices. For example, some embodiments of the control device 322 include a modem for communicating across the network.

The control device 322 typically includes at least some form of computer readable media. Computer readable media includes any available media that can be accessed by the control device 322. By way of example, computer readable media include computer readable storage media and computer readable communication media.

Computer readable storage media includes volatile and nonvolatile, removable and non-removable media implemented in any device configured to store information such as computer readable instructions, data structures, program modules or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the control device 322. Computer readable storage media does not include computer readable communication media.

Computer readable communication media typically embodies computer readable instructions, data structures, program modules or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

The computing device illustrated in FIG. 12 is also an example of programmable electronics, which may include one or more such computing devices, and when multiple computing devices are included, such computing devices can be coupled together with a suitable data communication network so as to collectively perform the various functions, methods, or operations disclosed herein.

The various examples and teachings described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A method of controlling a shifting position of a piston assembly reciprocating within a cylinder along a longitudinal axis, the method comprising:

selecting a shifting target position of the piston assembly adjacent a cylinder end head;

selecting a shifting trigger position of the piston assembly, the shifting trigger position arranged adjacent the shifting target position and being a position at which the piston assembly is preset to be triggered to being a shift in a direction of movement along the longitudinal axis, wherein the piston assembly moves in the same direction of movement along the longitudinal axis prior to and after the shifting trigger position;

detecting an actual shifting position of the piston assembly in a first cycle at which the piston assembly actually changes the direction of movement thereof to an opposite direction along the longitudinal axis;

determining a difference between the shifting target position and the actual shifting position in the first cycle; and adjusting the shifting trigger position of the piston assembly in a second cycle to compensate for the difference, the second cycle being subsequent to the first cycle.

2. The method according to claim 1, wherein the shifting target position enables a maximum possible stroke length of the piston assembly within the cylinder while preventing the piston assembly from hitting the cylinder end head.

3. The method according to claim 1, wherein the shifting trigger position is located before the shifting target position in a direction that the piston assembly moves along the longitudinal axis.

4. The method according to claim 1, wherein adjusting the shifting trigger position of the piston assembly comprises:

if the actual shifting position of the piston assembly passes the shifting target position in a direction that the piston assembly travels, setting a new shifting trigger position to advance an original shifting trigger position associated with the actual shifting position in the first cycle; and if the actual shifting position of the piston assembly falls short of the shifting target position in the direction that the piston assembly travels, setting a new shifting trigger position to delay the original trigger point.

5. The method according to claim 1, further comprising:

detecting a first speed of the piston assembly in a third cycle adjacent the cylinder end head;

detecting a second speed of the piston assembly in a fourth cycle adjacent the cylinder end head, wherein the fourth cycle is subsequent to the third cycle;

determining a difference between the first speed with the second speed; and adjusting a shifting trigger position of the piston assembly in the fourth cycle to make a shifting position in the fourth cycle substantially the same as a shifting position in the third cycle.

6. The method according to claim 5, wherein adjusting a shifting trigger position of the piston assembly in the fourth cycle comprises:

if the second speed is faster than the first speed, setting a new shifting trigger position to advance an original shifting trigger position associated with the shifting position in the third cycle; and if the second speed is slower than the first speed, setting a new shifting trigger position to delay the original shifting trigger position.

7. The method according to claim 5, wherein each of detecting a first speed of the piston assembly and detecting a second speed of the piston assembly comprises:

detecting a linear displacement of the piston assembly adjacent the cylinder end head for a predetermined period of time; and calculating a speed of the piston assembly by dividing the linear displacement by the predetermined period of time.

8. A water pump system comprising:

(a) a displacement pump comprising:

(i) a first cylinder;

(ii) a second cylinder arranged coaxially with the first cylinder;

(iii) a piston assembly including a first piston head, a second piston head, and a piston rod, the first piston head reciprocatingly movable within the first cylinder, the second piston head reciprocatingly movable within the second cylinder, and the piston rod axially extending between the first and second piston heads; and (iv) a piston position sensor assembly attached to the piston assembly and configured to detect a position of the piston assembly;

(b) a hydraulic fluid source selectively providing hydraulic fluid to the first cylinder;

(c) a water source selectively providing water to the second cylinder; and (d) a shifting control system comprising:

(i) a directional control valve unit configured to control a movement of the piston assembly by selectively providing the hydraulic fluid from the hydraulic fluid source to the first cylinder; and (ii) a control device configured to receive a piston position signal from the piston position sensor assembly and perform the method according to claim 1.

9. The water pump system according to claim 8, further comprising:

a pressure sensor configured to detect a water pressure generated by the displacement pump and send a pressure signal to the control device.

10. A method of controlling a shifting position of a piston assembly reciprocating within a cylinder along a longitudinal axis, the method comprising:

selecting a shifting target position of the piston assembly adjacent a cylinder end head;

detecting a shifting position of the piston assembly in a first cycle at which the piston assembly changes a direction of movement thereof to an opposite direction along the longitudinal axis;

determining a difference between the shifting target position and the shifting position in the first cycle;

adjusting a shifting trigger position of the piston assembly in a second cycle to compensate for the difference, the second cycle being subsequent to the first cycle detecting a first speed of the piston assembly in a third cycle adjacent the cylinder end head;

detecting a second speed of the piston assembly in a fourth cycle adjacent the cylinder end head, wherein the fourth cycle is subsequent to the third cycle;

determining a difference between the first speed with the second speed; and adjusting a shifting trigger position of the piston assembly in the fourth cycle to make a shifting position in the fourth cycle substantially the same as a shifting position in the third cycle.

11. The method according to claim 10, wherein adjusting a shifting trigger position of the piston assembly in the fourth cycle comprises:

if the second speed is faster than the first speed, setting a new shifting trigger position to advance an original shifting trigger position associated with the shifting position in the third cycle; and if the second speed is slower than the first speed, setting a new shifting trigger position to delay the original shifting trigger position.

12. The method according to claim 10, wherein each of detecting a first speed of the piston assembly and detecting a second speed of the piston assembly comprises:

detecting a linear displacement of the piston assembly adjacent the cylinder end head for a predetermined period of time; and calculating a speed of the piston assembly by dividing the linear displacement by the predetermined period of time.

13. A water pump system comprising:

(a) a displacement pump comprising:

(i) a first cylinder;

(ii) a second cylinder arranged coaxially with the first cylinder;

(iii) a piston assembly including a first piston head, a second piston head, and a piston rod, the first piston head reciprocatingly movable within the first cylinder, the second piston head reciprocatingly movable within the second cylinder, and the piston rod axially extending between the first and second piston heads; and (iv) a piston position sensor assembly attached to the piston assembly and configured to detect a position of the piston assembly;

(b) a hydraulic fluid source selectively providing hydraulic fluid to the first cylinder;

(c) a water source selectively providing water to the second cylinder; and (d) a shifting control system comprising:

(i) a directional control valve unit configured to control a movement of the piston assembly by selectively providing the hydraulic fluid from the hydraulic fluid source to the first cylinder; and (ii) a control device configured to receive a piston position signal from the piston position sensor assembly and perform the method according to claim 10.

14. The water pump system according to claim 13, further comprising:

a pressure sensor configured to detect a water pressure generated by the displacement pump and send a pressure signal to the control device.

* * * * *